US009897101B2

(12) United States Patent
Saito

(10) Patent No.: US 9,897,101 B2
(45) Date of Patent: Feb. 20, 2018

(54) IMPELLER FOR CENTRIFUGAL ROTARY MACHINE, AND CENTRIFUGAL ROTARY MACHINE

(71) Applicants: MITSUBISHI HEAVY INDUSTRIES, LTD., Tokyo (JP); MITSUBISHI HEAVY INDUSTRIES COMPRESSOR CORPORATION, Tokyo (JP)

(72) Inventor: Ryosuke Saito, Tokyo (JP)

(73) Assignees: MITSUBISHI HEAVY INDUSTRIES, LTD., Tokyo (JP); MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 397 days.

(21) Appl. No.: 14/418,065

(22) PCT Filed: Oct. 23, 2013

(86) PCT No.: PCT/JP2013/078691

§ 371 (c)(1),
(2) Date: Jan. 28, 2015

(87) PCT Pub. No.: WO2014/073377

PCT Pub. Date: May 15, 2014

(65) Prior Publication Data

US 2015/0159670 A1 Jun. 11, 2015

(30) Foreign Application Priority Data

Nov. 6, 2012 (JP) ..... 2012-244784

(51) Int. Cl.
*F04D 29/28* (2006.01)
*F04D 29/24* (2006.01)
(Continued)

(52) U.S. Cl.
CPC ..... *F04D 29/284* (2013.01); *F04D 17/122* (2013.01); *F04D 29/242* (2013.01);
(Continued)

(58) Field of Classification Search
CPC ..... F04D 29/284; F04D 29/242; F04D 29/30; F04D 29/281; F04D 29/2255;
(Continued)

(56) References Cited

U.S. PATENT DOCUMENTS 5,685,696 A 11/1997 Zangeneh et al.
2005/0260074 A1 11/2005 Higashimori

FOREIGN PATENT DOCUMENTS

CN 101109394 A 1/2008
DE 203 19 741 U1 10/2004
(Continued)

OTHER PUBLICATIONS

Chinese Office Action and Search Report, dated Feb. 2, 2016, for counterpart Chinese Application No. 201380038914.0, with an English translation.

(Continued)

*Primary Examiner* — Marina Tietjen
(74) *Attorney, Agent, or Firm* — Birch, Stewart, Kolasch & Birch, LLP

(57) ABSTRACT

An impeller for a centrifugal rotary machine has a plurality of blades (4) arranged at intervals in a circumferential direction on a face facing a direction of an axis of a disc (3) formed in a discoid shape about the axis, wherein the blades (4) each include a first section (10A) rising from the disc (3) and inclined toward an opposite direction of a rotary direction (R) as the distance from the disc and a second section (11A) continuing from the first section (10A) and inclined toward a forward direction of the rotary direction (R) as the distance from the disc (3) between the leading edges and the trailing edges in the blades (4).

7 Claims, 7 Drawing Sheets

(51) Int. Cl.
*F04D 29/30* (2006.01)
*F04D 29/22* (2006.01)
*F04D 17/12* (2006.01)

(52) U.S. Cl.
CPC ..... *F04D 29/30* (2013.01); *F04D 29/22* (2013.01); *F04D 29/2255* (2013.01); *F04D 29/281* (2013.01); *F05D 2240/301* (2013.01); *F05D 2240/306* (2013.01)

(58) Field of Classification Search
CPC .. F04D 29/22; F04D 17/122; F05D 2240/306; F05D 2240/301
USPC ..... 415/206; 416/223 B, 186 R
See application file for complete search history.

(56) References Cited

FOREIGN PATENT DOCUMENTS

| | | | | |
|---|---|---|---|---|
| EP | 2 426 362 | A2 | 3/2012 | |
| JP | 9-264296 | A | 10/1997 | |
| JP | 9-296799 | A | 11/1997 | |
| JP | 2000-154796 | A | 6/2000 | |
| JP | 2002-147390 | A | 5/2002 | |
| JP | 2002-364587 | A | 12/2002 | |
| JP | 2004-44473 | A | 2/2004 | |
| JP | 2005-307967 | A | 11/2005 | |
| WO | WO 9721035 | A1 * | 6/1997 | ..... F04D 29/2205 |

OTHER PUBLICATIONS

Extended European Search Report, dated Mar. 14, 2016, for counterpart European Application No. 13853233.8.
Notification—Third Party Observation mailed Mar. 6, 2015 in related Application No. PCT/JP2013/078691.
International Search Report issued in PCT/JP2013/078691, dated Dec. 10, 2013.
Office Action issued in Japanese Application No. 2012-244784, dated Dec. 10, 2013.
Submission of Information Statement issued in Japanese Patent Application No. 2012-244784, dated Jul. 3, 2014.
Written Opinion of the International Searching Authority issued in PCT/JP2013/078691, dated Dec. 10, 2013.

* cited by examiner

PORTION B

0%

PORTION A

20%

PORTION A

PORTION A

PORTION C

80%

PORTION D

100%

IMPELLER FOR CENTRIFUGAL ROTARY MACHINE, AND CENTRIFUGAL ROTARY MACHINE

TECHNICAL FIELD

The present invention relates to an impeller used for a centrifugal rotary machine such as a centrifugal compressor, a blower, and a centrifugal pump.

Priority is claimed on Japanese Patent Application No. 2012-244784, filed Nov. 6, 2012, the content of which is incorporated herein by reference.

BACKGROUND ART

In centrifugal rotary machines such as centrifugal compressors, there has been market demand for an increase in performance through improvement of a head, expansion of an operating range, or the like, and thus various measures have been taken, for the demand.

Here, in a flow path of an impeller used for the centrifugal rotary machine, a flow flowing in a direction different from a main stream, i.e., a secondary flow, may occur in some cases. Due to the secondary flow, a low energy fluid is accumulated in the flow path of the impeller and speed and energy of the fluid of the accumulated portion become considerably deficient. For this reason, such a secondary flow is one factor that degrades performance of the centrifugal rotary machine.

Patent Literature 1 discloses an impeller for a centrifugal compressor in which performance is improved by suppressing a secondary flow flowing from a pressure side toward a suction side of a blade in an impeller. Specifically, in the impeller, a boundary layer flow in a side wall surface of a flow path prevents the secondary flow from flowing to transect the flow path from the pressure side to the suction side of the blade with a riblet installed along a flow of a main stream from the side wall surface.

CITATION LIST

Patent Literature

[Patent Literature 1]

Japanese Unexamined Patent Application, First Publication No. H9-264296

SUMMARY OF INVENTION

Technical Problem

However, in the impeller of the rotary machine, a secondary flow different from that disclosed in Patent Literature 1 occurs in some cases. The secondary flow is a flow flowing in an axial direction away from a disc on the suction side in each flow path. Thus, a low energy fluid is accumulated in a position which is located at the suction side and away from the disc (directly under a cover in the case of a closed impeller), and is a factor that degrades performance of the rotary machine.

The present invention provides an impeller for a centrifugal rotary machine in which performance can be further improved by suppressing a secondary flow flowing away from a disc in an opposite direction of a rotary direction serving as a suction side of a blade.

Solution to Problem

According to a first aspect of the present invention, an impeller for a centrifugal rotary machine includes: a disc formed in a discoid shape about an axis; and a plurality of blades including a leading edge into which a fluid flows and a trailing edge out of which the fluid flows and arranged at intervals in a circumferential direction on a face facing a direction of the axis, wherein the blades each include a first section rising from the disc and inclined toward an opposite direction of a rotary direction as the distance from the disc and a second section continuing from the first section and inclined toward a forward direction of the rotary direction as the distance from the disc between the leading edges and the trailing edges in the blades.

According to the impeller described above, as the first section of the blade is inclined toward the opposite direction of the rotary direction, the first section is disposed to swell toward the opposite direction of the rotary direction. For this reason, the secondary flow occurring at the opposite direction of the rotary direction and flowing away from the disc is pushed toward the first section swollen toward the opposite direction of the rotary direction. Thus, the secondary flow is divided into a tangential direction component at a point at which the secondary flow comes into contact with the first section and a normal direction component that is a component perpendicular to the tangential direction component and pushing the secondary flow toward the first section. Here, if the first section is not inclined toward the opposite direction of the rotary direction, the secondary flow is not in contact with the first section and a component in the normal direction becomes 0 (zero). As such, the entire secondary flow flows away from the disc. According to an aspect of the present invention, since a portion of the secondary flow flows in the normal direction and the remainder flows in the tangential direction, the entire secondary flow does not flow toward a position away from the disc. Further, as the secondary section of the blade is inclined toward the forward direction of the rotary direction, it is possible to receive a pressing force of the fluid from the forward direction of the rotary direction. For this reason, even when the first section is inclined toward the opposite direction of the rotary direction, it is possible to effectively use the pressing force from the fluid and compression efficiency is not reduced.

According to a second aspect of the present invention, the impeller for the centrifugal rotary machine may further includes a third section disposed closer to the leading edge than the first section, rising from the disc, and inclined toward the forward direction of the rotary direction as the distance from the disc; and a fourth section disposed closer to the leading edge than the second section, continuing from the third section, and inclined toward the forward direction of the rotary direction as the distance from the disc.

According to the second section, the third section, and the fourth section described above, since it is possible to receive reliably the pressing force of the fluid from the forward direction of the rotary direction on the leading edge side of the blade and suppress the secondary flow flowing away from the disc in the rear side of the rotary direction, performance can be further improved.

According to a third aspect of the present invention, the impeller for the centrifugal rotary machine may further includes: a fifth section disposed closer to the trailing edge than the first section, rising from the disc, and inclined toward the opposite direction of the rotary direction as the distance from the disc; and a sixth section disposed closer to the trailing edge than the second section, continuing from the fifth section, and inclined toward the opposite direction of the rotary direction as the distance from the disc.

According to a fourth aspect of the present invention, the impeller for the centrifugal rotary machine may further includes: a seventh section disposed closer to the trailing edge than the fifth section, rising from the disc, and inclined toward the forward direction of the rotary direction as the distance from the disc; and an eighth section disposed closer to the trailing edge than the sixth section, continuing from the seventh section, and inclined toward the forward direction of the rotary direction as the distance from the disc.

According to a fifth aspect of the present invention, a centrifugal rotary machine includes: a rotary shaft configured to rotate about an axis; the impeller for the centrifugal rotary machine externally engaged with the rotary shaft and configured to rotate together with the rotary shaft; and a casing configured to rotatably support the rotary shaft and cover the impeller from an outer circumference side of the impeller.

According to the centrifugal rotary machine described above, as the blade of the impeller includes the first section and second section, at a contact point between the blade and the secondary flow occurring at the opposite direction of the rotary direction, since a portion of the secondary flow flows in the normal direction of the contact point and the remainder flows in the tangential direction, the entire secondary flow does not flow toward a position away from the disc. Further, it is possible to receive the pressing three of the fluid from the forward direction of the rotary direction by the second section.

Advantageous Effects of Invention

According to the impeller and the centrifugal rotary machine described above, as the blade includes the first section and the second section, it is possible to suppress the secondary flow flowing away from the disc in the opposite direction of the rotary direction, effectively use the pressing force from the fluid, and improve performance.

DESCRIPTION OF EMBODIMENTS

First Embodiment

Hereinafter, a centrifugal compressor (centrifugal rotary machine) 100 related to an embodiment of the present invention will be described.

Figure 1:
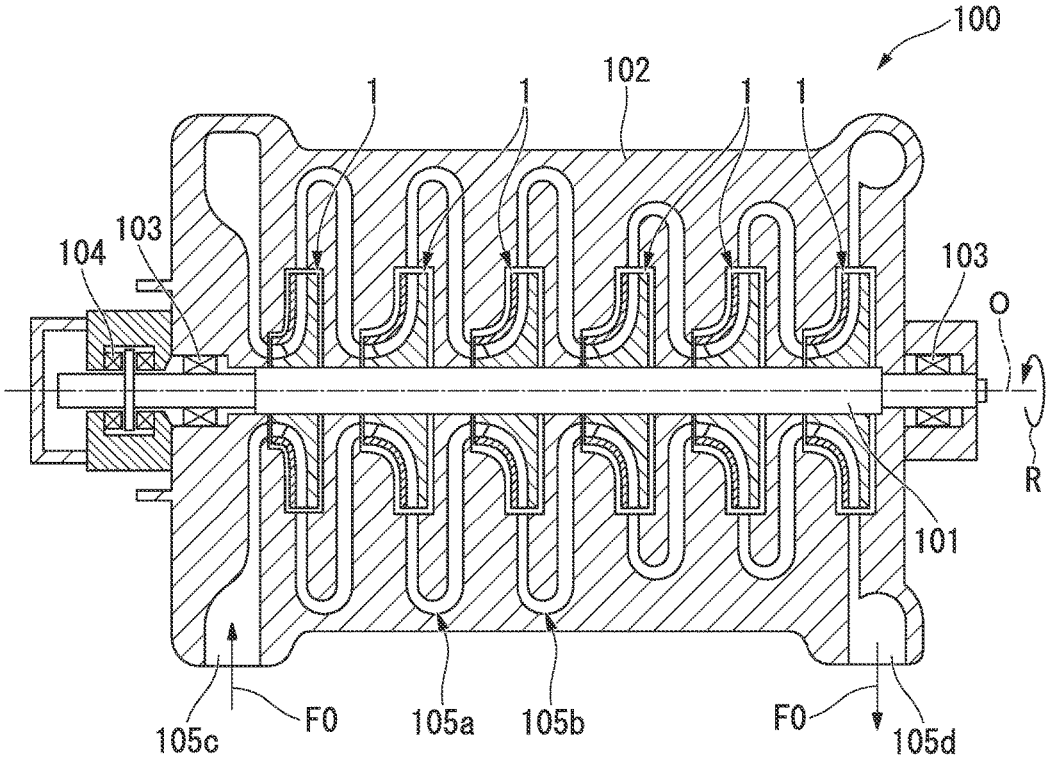
FIG. 1 is an overall schematic diagram showing a centrifugal compressor related to an embodiment of the present invention.

As shown in FIG. 1, the centrifugal compressor 100 includes a casing 102, a rotary shaft 101 which is axially supported via a journal hearing 103 and a thrust bearing 104 inside the casing 102 and configured to be rotatable about an axis O, and an impeller 1 externally engaged with the rotary shaft 101 in parallel with an axis O direction.

The centrifugal compressor 100 uses a centrifugal force of the impeller 1 rotated with the rotary shaft 101 to cause a fluid F0 supplied from a suction port 105*c* formed in the casing 102 to flow from a flow path 105*a* of an upstream side to a flow path 105*b* of a downstream side in stages. Also, while the fluid F0 flows, the centrifugal compressor 100 rises pressure of the fluid F0 and discharges the fluid F0 from a discharge port 105*d*.

Next, the impeller 1 will be described.

The impeller 1 is externally engaged with the rotary shaft 101 and rotates about the axis O with the rotary shaft 101 in a rotary direction R. Note that, in the embodiment, the plurality of (six) impellers 1 are provided and configures a multi-stage centrifugal compressor.

Figure 2:
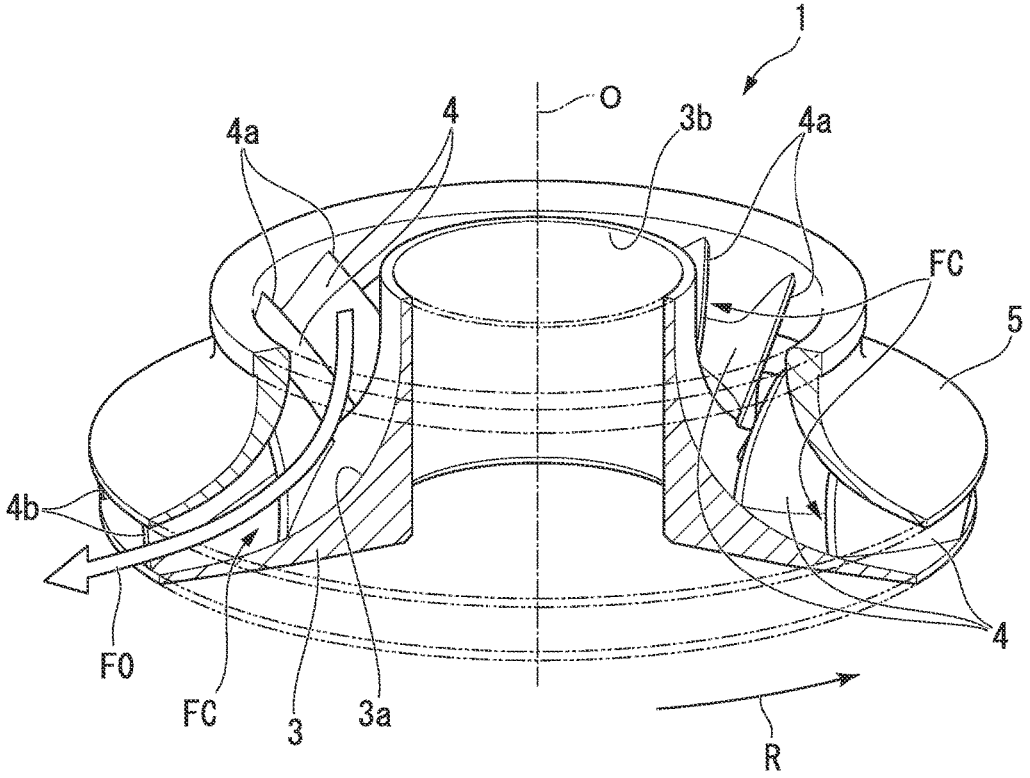
FIG. 2 is a perspective view showing an impeller in the centrifugal compressor related to the embodiment of the present invention, a portion of which is cut out.
Figure 3:
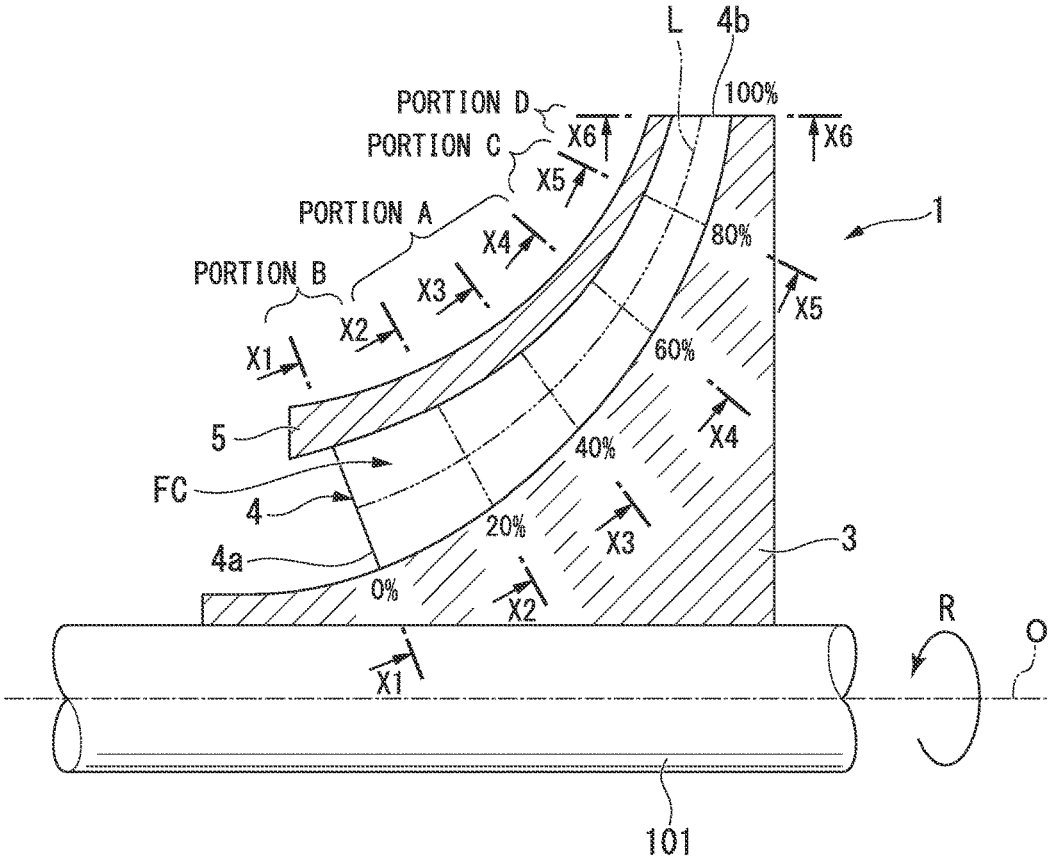
FIG. 3 is a meridional view showing a major part of the impeller in the centrifugal compressor related to the embodiment of the present invention.

As shown in FIG. 2, each impeller 1 includes a disc 3 formed in a substantially discoid shape when viewed in the axis O direction, a plurality of blades 4 provided on the disc 3, and a cover 5 configured to cover the blades 4 in the axis O direction.

The disc 3 has an end face facing a first direction of the axis O direction and configured to have a small diameter and an end face facing a second direction of the axis O direction and configured to have a large diameter. Further, as the two end faces are connected by a curved surface 3*a* gradually enlarged in diameter from the first direction to the second direction of the axis O direction, the disc 3 has a substantially discoid shape when viewed in the axis O direction and is a member having substantially an umbrella shape as a whole.

In addition, a through-hole 3*b* configured to penetrate through the disc 3 in the axis O direction is formed inside in a radial direction of the disc 3. As the rotary shaft 101 is inserted and fitted into the through-hole 3*b*, the impeller 1 can be fixed to the rotary shaft 101 and rotated integrally with the rotary shaft 101.

The blades 4 are a plurality of members disposed at certain intervals in the circumferential direction of the axis O, i.e., the rotary direction R, so as to rise from the curved surface 3*a* in the disc 3 to the first direction in the axis O direction.

In addition, the plurality of blades 4 are each formed to be curved toward the opposite direction of the rotary direction R as they go from the inside toward the outside in the radial direction of the disc 3. Also, a face facing the forward direction of the rotary direction R is a pressure side of the blade and a face facing the opposite direction of the rotary direction R is a suction side of the blade.

The cover 5 is a member formed integrally with the plurality of blades 4 so as to cover the blades 4 from the first direction of the axis O direction, and has substantially an umbrella shape that gradually enlarges in diameter toward the second direction of the axis O direction. In other words, in the embodiment, the impeller 1 is a closed impeller having a cover 5.

Also, a space surrounded by the two neighboring blades 4, the disc 3, and the cover 5 is defined as an impeller flow path FC in which the fluid F0 can flow from the inside toward the outside in the radial direction. The fluid F0 is introduced from the first direction of the axis O direction of the impeller 1, i.e., the leading edge 4*a* side of the blade 4, into the impeller flow path FC, and is discharged horn the trailing edge 4*b* side of the blade 4 serving as the outside in the radial direction.

Next, the blades 4 will be described in greater detail.

As shown in FIGS. 3 and 4A to 4F, the blades 4 each include a portion B, a portion A, a portion C, and a portion D in order from the leading edge 4*a* toward the trailing edge 4*b*.

The portion A includes a first section 10A formed at a position near the disc 3 so as to continue from the disc 3 on a side closest to the leading edge 4*a* in the blade 4, and a second section 11A extending away from the disc so as to continue from the first section 10A. In other words, the first section 10A and the second section 11A are consecutively formed using an imaginary line L defined at a halfway position of a direction in which the blade 4 rises (in the embodiment, a central position of a direction in which the blade 4 rises) as a boundary.

Here, in connection with the blade 4, an inclined angle formed between the blade 4 and an imaginary line L1 rising at a right angle from the curved surface 3*a* of the disc 3 (the imaginary line L1 rising at a right angle from a tangential line L2 in a contact point P between the blade 4 and the curved surface 3*a*) is assumed to be a lean angle α.

In the blade 4, the first section 10A rises from the disc 3 having the lean angle α inclined toward the opposite direction of the rotary direction R and is formed to be smoothly curved as the distance from the disc 3.

The second section 11A continues from the first section 10A toward the cover 5 and extends to be smoothly curved and inclined toward the forward direction of the rotary direction R the distance from the disc 3.

Figure 4A:
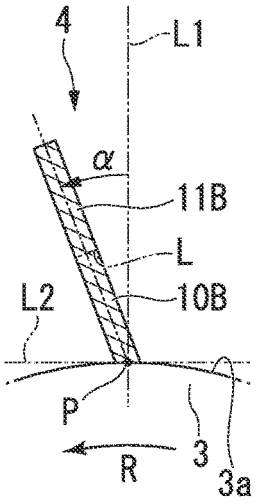
FIG. 4A is a cross-sectional view of the blade of the impeller in the centrifugal compressor related to the embodiment of the present invention, showing a cross section X1-X1 of FIG. 3.
Figure 4B:
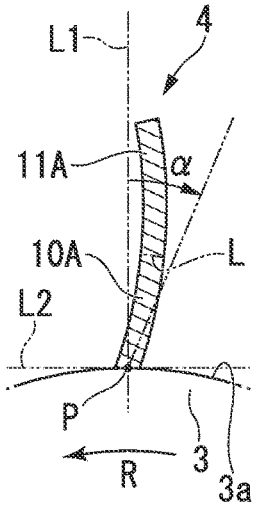
FIG. 4B is a cross-sectional view of the blade of the impeller in the centrifugal compressor related to the embodiment of the present invention, showing a cross section X2-X2 of FIG. 3.
Figure 4C:
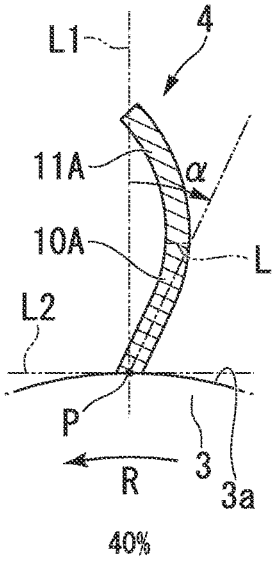
FIG. 4C is a cross-sectional view of the blade of the impeller in the centrifugal compressor related to the embodiment of the present invention, showing a cross section X3-X3 of FIG. 3.
Figure 4D:
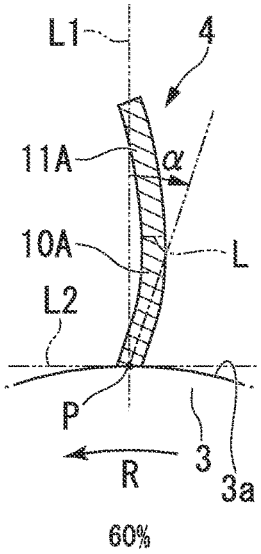
FIG. 4D is a cross-sectional view of the blade of the impeller in the centrifugal compressor related to the embodiment of the present invention, showing a cross section X4-X4 of FIG. 3.

Here, examples of positions in which the first section 10A and the second section 11A are formed are illustrated in FIGS. 4B, 4C, and 4D. In other words, in the embodiment, the first section 10A and the second section 11A are, for example, formed at a position corresponding to 1.5% to 65% along a meridional plane of the impeller 1 from the leading edge 4*a*.

In the embodiment, in the first section 10A, the lean angle α is maximized at a position of 40% while the lean angle α gradually increases from the leading edge 4*a* side of the blade 4 and then gradually decreases toward the trailing edge 4*b* side of the blade 4. In other words, at a position corresponding to 40% along the meridional plane, the first section 10A of the blade 4 is most inclined toward the opposite direction of the rotary direction R. A position which is most inclined toward the opposite direction of the rotary direction R is not limited to the position corresponding to 40% along the meridional plane, and the numerical value of 40% is an example.

In addition in the second section 11A, a degree of curvature is maximized at a position of 40% while the degree of curvature gradually increases from the leading edge 4*a* side of the blade 4, and then gradually decreases toward the trailing edge 4*b* side of the blade 4. In other words, at a position corresponding to 40% along the meridional plane, the second section 11A of the blade 4 is most inclined toward the forward direction of the rotary direction R. A position which is most inclined toward the forward direction of the rotary direction R is not limited to the position corresponding to 40% along the meridional plane, and the numerical value of 40% is an example.

The portion B is a portion located closer to the leading edge 4*a* side of the blade 4 than the portion A, and includes a third section 10B formed at a position near the disc 3 so as to continue from the disc 3 and a fourth section 11B extending away from the disc so as to continue from the third section 10B using the imaginary line L as a boundary.

As shown in FIG. 4A, the third section 10B is provided to have the lean angle α inclined toward the forward direction of the rotary direction R, rise from the disc 3 at a side closer to the leading edge 4*a* of the blade 4 than the first section 10A, and extend in a linear shape as the distance from the disc 3.

In addition, the fourth section 11B extends to straightly extend the third section 10B in a linear shape without being inclined from a connection section of the third section 10B and the fourth section 11B at a side closer to the leading edge 4*a* of the blade 4 than the second section 11A. In other words, the fourth section 11B is inclined toward the forward direction of the rotary direction R.

Here, an example of positions in which the third section 10B and the fourth section 11B are formed is illustrated in FIG. 4A, in other words, in the embodiment, the third section 10B and the fourth section 11B are, for example, thrilled from a position corresponding to 0% on the meridional plane of the impeller 1 to a position of the leading edge 4*a* side of the portion A, i.e., near the leading edge 4*a*.

The portion C is a portion located closer to the trailing edge 4*b* side of the blade 4 than the portion B, and includes a fifth section 10C formed at a position near the disc 3 so as to continue from the disc 3 and a sixth section 11C extending away from the disc 3 so as to continue from the fifth section 10C using the imaginary line L as a boundary.

Figure 4E:
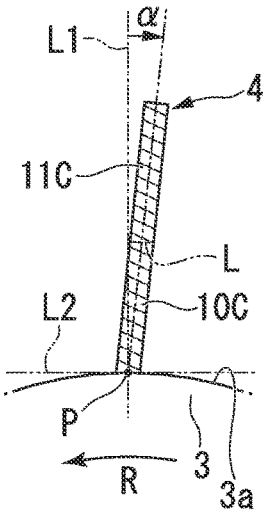
FIG. 4E is a cross-sectional view of the blade of the impeller in the centrifugal compressor related to the embodiment of the present invention, showing a cross section X5-X5 of FIG. 3.

As shown in FIG. 4E, the fifth section 10C is provided to have the lean angle α inclined toward the opposite direction of the rotary direction R, rise from the disc 3 at a side closer to the trailing edge 4*b* of the blade 4 than the first section 10A, and extend in a linear shape as the distance from the disc 3.

In addition, the sixth section 11C extends to straightly extend the fifth section 10C in a linear shape without being inclined from a connection section of the fifth section 10C and the sixth section 11C at a side closer to the trailing edge 4*b* of the blade 4 than the second section 11A. In other words, the sixth section 11C is inclined toward the opposite direction of the rotary direction R.

Here, an example of positions in which the fifth section 10C and the sixth section 11C are formed is illustrated in FIG. 4E. In other words, in the embodiment, the fifth section 10C and the sixth section 11C are, for example, formed from the trailing edge 4*b* side of the portion A to a position corresponding to 85% along the meridional plane of the impeller 1.

The portion D is a portion located closer to the trailing edge 4*b* of the blade 4 than the portion C, and includes a seventh section 10D formed at a position near the disc 3 so as to continue from the disc 3 and an eighth section 11D extending away from the disc so as to continue from the seventh section 10D using the imaginary line L as a boundary.

As shown in FIG. 4E, the seventh section 10D is provided to have the lean angle α inclined toward the forward direction of the rotary direction R and extend in a linear shape away from the disc 3 at a side closer to the trailing edge 4*b* of the blade 4 than the fifth section 10C, as with the leading edge 4*a* of the blade 4.

In addition, the eighth section 11D extends to straightly extend the seventh section 10D in a linear shape without being inclined from a connection section of the seventh section 10D and the eighth section 11D at a side closer to the trailing edge 4*b* of the blade 4 than the sixth section 11D. In other words, the eighth section 11D is inclined toward the forward direction of the rotary direction R as with the leading edge 4*a*.

Figure 4F:
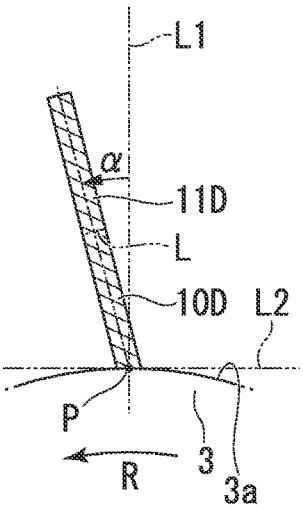
FIG. 4F is a cross-sectional view of the blade of the impeller the centrifugal compressor related to the embodiment of the present invention, showing a cross section X6-X6 of FIG. 3.

Here, an example of positions in which the seventh section 10D and the eighth section 11D are formed is illustrated in FIG. 4F. In other words, in the embodiment, the seventh section 10D and the eighth section 11D are, for example, formed from the trailing edge 4*b* side of the portion C to a position corresponding to 100% along the meridional plane of the impeller 1, i.e., near the trailing edge 4*b*.

As described above, at at least one place between the leading edge 4*a* and the trailing edge 4*b* of the blade 4, there is a place inclined toward the opposite direction of the rotary direction R on a side closer to the disc 3 than the imaginary line L.

Figure 5:
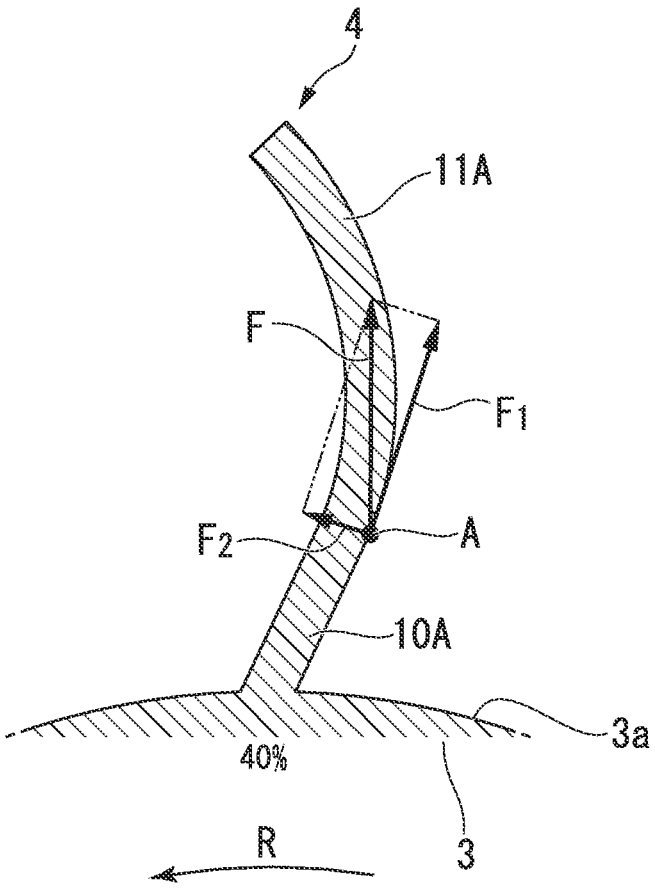
FIG. 5 is a cross-sectional view of the blade of the impeller in the centrifugal compressor related to the embodiment of the present invention, showing a direction of a secondary flow of FIG. 4C.

Such a centrifugal compressor includes the first section 10A in which the blade 4 is inclined toward the opposite direction of the rotary direction R. The first section 10A is disposed to swell toward the opposite direction of the rotary direction R. Thus, when the secondary flow F flowing along the suction side of the blade 4 away from the disc 3 as shown in FIG. 5 occurs in the opposite direction of the rotary direction R of the blade 4 along with the rotation of the impeller 1, the secondary flow F may contact and push the first section 10A.

In other words, the secondary flow F is divided into a tangential direction component $F_1$ at a point A on the suction side of the blade 4 in contact with the first section 10A and a normal direction component $F_2$ perpendicular to the tangential direction component $F_1$. Also, the normal direction component $F_2$ is a component pushing the secondary flow F toward the first section 10.

Here, if the first section 10A is not inclined toward the opposite direction of the rotary direction R, the secondary flow is not in contact with the first section 10A and the normal direction component $F_2$ becomes 0 (zero). As such, the entire secondary flow F flows away from the disc 3. On the other hand, in the embodiment, since a portion of the secondary flow F flows in a normal direction $F_2$ and the remainder flows in a tangential direction $F_1$, the entire secondary flow F does not flow toward a position away from the disc 3.

In addition, as the blade 4 includes the second section 11A inclined toward the forward direction of the rotary direction R, it is possible for the blade 4 to receive the pressing force of the fluid F0 on the pressure side of the blade 4. For this reason, even when the first section 10A is inclined toward the opposite direction of the rotary direction R, compression efficiency is not reduced.

In addition, the blade 4 includes the third section 10B and the fourth section 11B which are inclined toward the forward direction of the rotary direction R at the position corresponding to 0% along the meridional plane. As such, when the fluid F0 is introduced into the flow path FC, it is possible for the blade 4 to reliably receive the pressing force of the fluid F0 on the pressure side at the leading edge 4*a* side of the blade 4. Therefore, the fluid F0 can be compressed with higher efficiency.

According to the centrifugal rotary machine of the embodiment, the first section 10A of the blade 4 is inclined toward the opposite direction of the rotary direction R and the second section 11A of the blade 4 is inclined toward the forward direction of the rotary direction R between the leading edge 4*a* and the trailing edge 4*b*. For this reason, the secondary flow F flowing away from the disc 3 in the opposite direction of the rotary direction R can be suppressed, and accumulation of the low energy fluid at a position in the opposite direction of the rotary direction R of the blade 4, which is a position away from the disc 3, i.e., close to the cover 5, can be suppressed.

In addition, the pressure side of the blade 4 can receive the pressing force from the fluid F0 to effectively use the force, maintain compression efficiency while suppressing the secondary flow F, and improve performance.

The embodiments of the present invention have been described above in detail, but some design changes can be made without departing from the spirit of the technical scope of the present invention.

For example, the blade 4 may have the first section 10A inclined toward the opposite direction of the rotary direction R and the second section 11A inclined toward the forward direction of the rotary direction R so as to continue from the first section 10A provided on at least one place between the leading edge 4*a* and the trailing edge 4*b* of the blade 4. Therefore, an inclination direction and a shape with respect to the third section 10B, the fourth section 11B, the fifth section 10C, the sixth section 11C, the seventh section 10D, and the eighth section 11D are not limited to the above-described embodiments. Further, the third section 10B, the fourth section 11B, the fifth section 10C, the sixth section 11C, the seventh section 10D, and the eighth section 11D may be provided to be arranged on the imaginary line L1 without being inclined in the rotary direction R.

In addition, the first section 10A and the second section 11A are provided to be curved in the above-described embodiments, but may be provided in a linear shape.

In addition, the description has been made on the assumption that the impeller is the closed impeller in the above-described embodiments, but an open impeller having no cover 5 may be used.

In addition, the centrifugal compressor 100 is not limited to the multi-stage compressor, and the above-described blade 4 of the impeller 1 can also be applied to a single-stage compressor.

Also, the centrifugal compressor is not necessarily used as the centrifugal rotary machine in the present invention, and a blower and a centrifugal pump may be used.

INDUSTRIAL APPLICABILITY

According to the impeller and the centrifugal rotary machine described above, as the blade includes the first section and the second section, it is possible to suppress the secondary flow flowing away from the disc in the opposite direction of the rotary direction, effectively use the pressing force from the fluid, and improve performance.

REFERENCE SIGNS LIST

1 Impeller
3 Disc
3*a* Curved surface
3*b* Through-hole
4 Blade
4*a* Leading edge
4*b* Trailing edge
5 Cover
10A First section
11A Second section
10B Third section
11B Fourth section
10C Fifth section
11C Sixth section
10D Seventh section
11D Eighth section
O Axis
F0 Fluid
F Secondary flow
P Contact point
$F_1$ Tangential direction component
$F_2$ Normal direction component
FC Impeller flow path
L, L1 Imaginary line
L2 Tangential line
R Rotary direction
100 Centrifugal compressor (centrifugal rotary machine)
101 Rotary shaft
102 Casing
103 Journal bearing
104 Thrust bearing
105*a* Flow path
105*b* Flow path
105*c* Suction port
105*d* Discharge port

The invention claimed is:

1. An impeller for a centrifugal rotary machine, comprising:
a disc formed in a discoid shape about an axis;
a plurality of blades including a leading edge into which a fluid flows and a trailing edge out of which the fluid flows and arranged at intervals in a circumferential direction on a face facing a direction of the axis, and
an impeller fluid flow path being defined by neighboring blades,
wherein, between the leading edges and the trailing edges in the blades, each blade viewed in a cross-section perpendicular to the impeller fluid flow path includes:
a first area rising from the disc and inclined toward an opposite direction of a rotary direction relative to the distance from the disc;
a second area further rising from the first area and inclined toward a forward direction of the rotary direction as the distance from the disc;
a seventh area disposed closer to the trailing edge than the first area, rising from the disc, and inclined toward the forward direction of the rotary direction relative to the distance from the disc; and
an eighth area disposed closer to the trailing edge than the second area, further rising from the seventh area, and inclined toward the forward direction of the rotary direction relative to the distance from the disc.

2. The impeller for a centrifugal rotary machine according to claim 1, wherein each blade viewed in a cross-section perpendicular to the impeller flow path further includes:
a third area disposed closer to the leading edge than the first area, rising from the disc, and inclined toward the forward direction of the rotary direction relative to the distance from the disc; and
a fourth area disposed closer to the leading edge than the second area, further rising from the third area, and inclined toward the forward direction of the rotary direction relative to the distance from the disc.

3. The impeller for a centrifugal rotary machine according to claim 2, wherein each blade viewed in a cross-section perpendicular to the impeller flow path further includes:
a fifth area disposed closer to the trailing edge than the first area and closer to the leading edge than the seventh area, rising from the disc, and inclined toward the opposite direction of the rotary direction relative to the distance from the disc; and
a sixth area disposed closer to the trailing edge than the second area and closer to the leading edge than the eighth area, further rising from the fifth area, and inclined toward the opposite direction of the rotary direction relative to the distance from the disc.

4. A centrifugal rotary machine, comprising:
a rotary shaft configured to rotate about an axis;
the impeller for a centrifugal rotary machine according to claim 2 externally engaged with the rotary shaft and configured to rotate together with the rotary shaft; and
a casing configured to rotatably support the rotary shaft and cover the impeller from an outer circumference side of the impeller.

5. The impeller for a centrifugal rotary machine according to claim 1, wherein each blade viewed in a cross-section perpendicular to the impeller flow path further includes:
a fifth area disposed closer to the trailing edge than the first area and closer to the leading edge than the seventh area, rising from the disc, and inclined toward the opposite direction of the rotary direction relative to the distance from the disc; and
a sixth area disposed closer to the trailing edge than the second area and closer to the leading edge than the eighth area, further rising from the fifth area, and inclined toward the opposite direction of the rotary direction relative to the distance from the disc.

6. A centrifugal rotary machine, comprising:
a rotary shaft configured to rotate about an axis;
the impeller for a centrifugal rotary machine according to claim 5 externally engaged with the rotary shaft and configured to rotate together with the rotary shaft; and
a casing configured to rotatably support the rotary shaft and cover the impeller from an outer circumference side of the impeller.

7. A centrifugal rotary machine, comprising:
a rotary shaft configured to rotate about an axis;
the impeller for a centrifugal rotary machine according to claim 1 externally engaged with the rotary shaft and configured to rotate together with the rotary shaft; and
a casing configured to rotatably support the rotary shaft and cover the impeller from an outer circumference side of the impeller.

* * * * *